US006986680B2

(12) United States Patent
Wu

(10) Patent No.: US 6,986,680 B2
(45) Date of Patent: Jan. 17, 2006

(54) CONDUCTIVE WIRE INSERTION DEVICE FOR INSTALLING A LAMP ROD

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/916,622

(22) Filed: Aug. 12, 2004

(65) Prior Publication Data

US 2005/0042917 A1 Feb. 24, 2005

Related U.S. Application Data

(63) Continuation of application No. 10/054,466, filed on Jan. 24, 2002, now abandoned.

(51) Int. Cl.
*H01R 13/73* (2006.01)

(52) U.S. Cl. ..... 439/551; 439/320

(58) Field of Classification Search ..... 439/551, 439/546, 579, 320–322
See application file for complete search history.

(56) References Cited

U.S. PATENT DOCUMENTS 1,890,617 A * 12/1932 Lamy ..... 439/242
3,039,072 A * 6/1962 Robinson et al. ..... 439/320
3,673,544 A * 6/1972 Dupree ..... 439/356
3,750,090 A * 7/1973 Teman ..... 439/551
4,060,299 A * 11/1977 Williams ..... 439/289
5,769,661 A * 6/1998 Nealis ..... 439/551

* cited by examiner

*Primary Examiner*—Hien Vu
(74) *Attorney, Agent, or Firm*—Troxell Law Office, PLLC

(57) ABSTRACT

A conductive wire insertion device for installing a lamp rod including a retaining seat and a locking seat. The retaining seat has a stepped through hole. A larger stepped hole of the through hole is exactly inserted by a female joint of a first electric wire. A male joint of a second electric wire is exactly positioned in a bottom stepped hole of the inserting hole. After the locking seat inserts into the retaining seat from a top end thereof, a male joint slightly protruded from a bottom end of the locking seat has an end portion which is exactly inserted into the female joint. A user only inserts the locking seat into the retaining seat without using any locking tool. Thus, the user may assemble it by himself or herself.

5 Claims, 3 Drawing Sheets

CONDUCTIVE WIRE INSERTION DEVICE FOR INSTALLING A LAMP ROD

This is the continuation in part of the U.S. patent Ser. No. 10/054,466 filed Jan. 24, 2002, now abandoned which is filed by the inventor of this application. The contents of U.S. patent Ser. No. 10/054,466 are thus incorporated into the present invention as a part of this specification.

BACKGROUND OF THE INVENTION

1. Field of the Invention

The present invention relates to wire connection devices of lamps, and particularly to a conductive wire insertion device for installing a lamp rod. The user only inserts a lamp rod into the retaining seat of a wire connecting box without using any locking tool. Thus, the user can assemble the wire connecting box by himself or herself.

2. Description of Related Art

In the prior art, wire connection devices of lamps, such as wall lamps, stand type lamps, ceiling lamps, use studs and nuts to lock their components. In assembly, a user must use tools (such as spanners, openers, etc) to assembly the lamp, and it is often that the user is harmed. Moreover, in assembly, it is often that electric wires expose out and some dangerous events occur. Thereby, the prior art lamps are not suitable to be assembled by the user. In general, the manufacturer assembles lamp devices in advance, namely, wire boxes are assembled with inserting rods in the manufacturing process. However, a large space is required for transferring and storing wire connection devices and thus cost is increased.

SUMMARY OF THE INVENTION

Accordingly, the primary object of the present invention is to provide a conductive wire insertion device for installing a lamp rod. The conductive wire insertion device comprises a retaining seat and a locking seat. The retaining seat has a stepped through hole. A larger stepped hole of the through hole is exactly inserted by a female joint of a first electric wire. A male joint of a second electric wire is exactly positioned in a bottom stepped hole of the inserting hole. After the locking seat inserts into the retaining seat from a top end thereof, the male joint has an end portion which is exactly inserted into the female joint in the retaining seat; as a result, the first and second electric wire are conducted.

Another object of the present invention is to provide a conductive wire insertion device for installing a lamp rod, wherein the locking seat and the lamp rod are capable of being pulled out from the retaining seat for reducing the necessary storage space. Since the retaining seat is assembled to the wire connecting box, the user only inserts the locking seat into the retaining seat. Then, it can be used without using any locking tool; thus, the user may assemble it by himself or herself.

The various objects and advantages of the present invention will be more readily understood from the following detailed description when read in conjunction with the appended drawing.

DETAILED DESCRIPTION OF THE PREFERRED EMBODIMENTS

Figures 1, 1A, 1B, 1C, 1D:
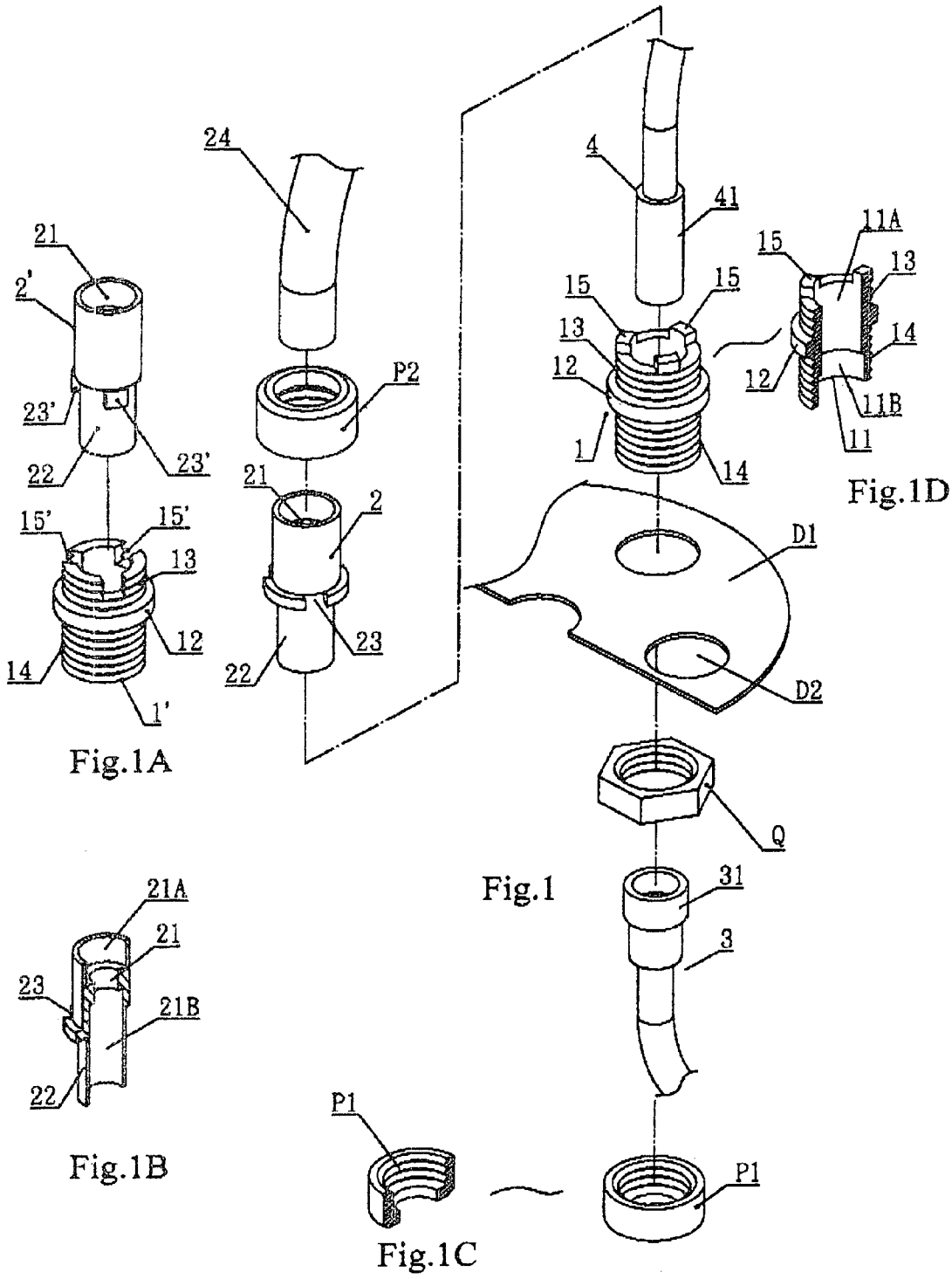
FIG. 1 is an exploded perspective view of the present invention.
FIG. 1A shows another embodiment of the present invention.
FIG. 1B is a sectional view of the locking seat of FIG. 1.
FIG. 1C is a sectional view of the inner threaded ring of FIG. 1.
FIG. 1D is a sectional view of the retaining seat of FIG. 1.
Figure 2:
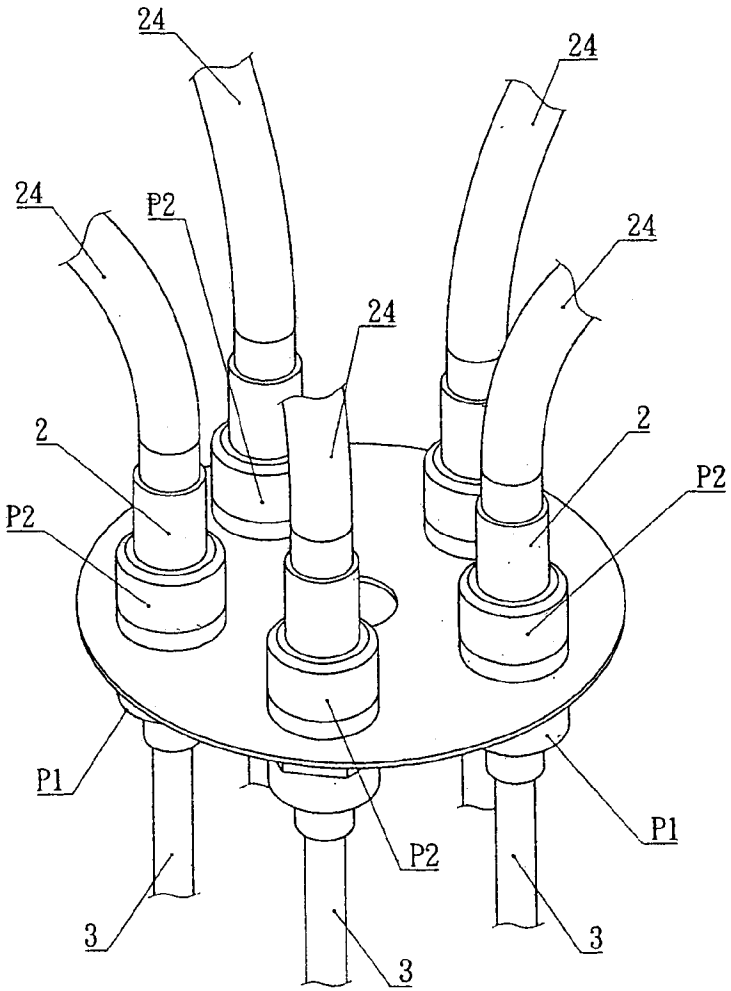
FIG. 2 shows an assembled view of the present invention.

Referring to FIGS. 1, 1A and 2, the conductive wire insertion device for installing a lamp rod of the present invention is illustrated. The conductive wire insertion device includes a retaining seat 1 installed in a bottom plate D1 of a wire connecting box (not shown), and a locking seat 2 inserted in a retaining seat 1.

With reference to FIG. 1 and FIG. 1A, wherein FIG. 1A is another embodiment of the present invention, which shows another structure of the retaining seat 1 and the locking seat 2. In the following description, the structure of FIG. 1 is described, while the structure of FIG. 1A is indicated in parentheses. The retaining seat 1 has a stepped through hole 11. Thereby, the locking seat 2 is exactly inserted into a smaller stepped hole 11A of the through hole 11 and then positioned therein. The larger stepped hole 11B of the through hole 11 is exactly inserted by a female joint 31 of an electric wire 3. An outer side of the retaining seat 1 is protruded with a flange 12 for resisting against the bottom plate D1. Two sides of the flange 12 are a front threaded section 13 and a rear threaded section 14. Thereby, after the retaining seat 1 is inserted into a via hole D2 of the bottom plate D from a top end of the wire connecting box. The bottom plate D1 of the wire connecting box is locked with a female screw Q. Thereby, the retaining seat 1 is positioned to the wire connecting box. A top edge of the retaining seat 1 (1') is protruded with two protrusions 15 (or grooves 15' in FIG. 1A) for preventing the locking seat 2 from rotation. Furthermore, the rear threaded section 14 of the retaining seat 1 is locked to an inner threaded ring P1. The electric wire 3 passes through the inner threaded ring P1. A lower end of the inner threaded ring P1 exactly supports the female joint 31 of the electric wire 3 for preventing the electric wire 3 from falling down.

An interior of the locking seat 2 has a two-staged stepped inserting hole 21. Thereby, an electric wire 4 is exactly inserted from a lower end of the locking seat 2 and then the male joint 41 of the electric wire 4 is exactly positioned in a bottom stepped hole 21B of the inserting hole 21. An end portion of the male joint slightly protrudes from a bottom end 22 of the locking seat 2. After the locking seat 2 inserts into the retaining seat 1 from a top end thereof. The male joint 41 has an end portion which is exactly inserted into the female joint 31 in the retaining seat 1. As a result, the wire is conducted. The parts of the annular surface of the locking seat 2 (2') engaged with the protrusions 15 (or grooves 15' in FIG. 1A) of the retaining seat 1 are formed with grooves 23 (or blocks 23' in FIG. 1A) for preventing the locking seat 2 (2') from rotation. After the locking seat 2 is inserted into the retaining seat 1, an inner threaded ring P2 is placed around the upper part of the locking seat 2. The inner threaded ring P2 is exactly locked to the front threaded section 13 of the retaining seat 1. Thereby, the locking seat 2 is positioned to the retaining seat 1.

Moreover, in the top stepped hole 21A of the locking seat 2, a hollow lamp rod 24 is welded therein. The lamp rod 24 can be passed through by the electric wire 4.

Figure 3B:
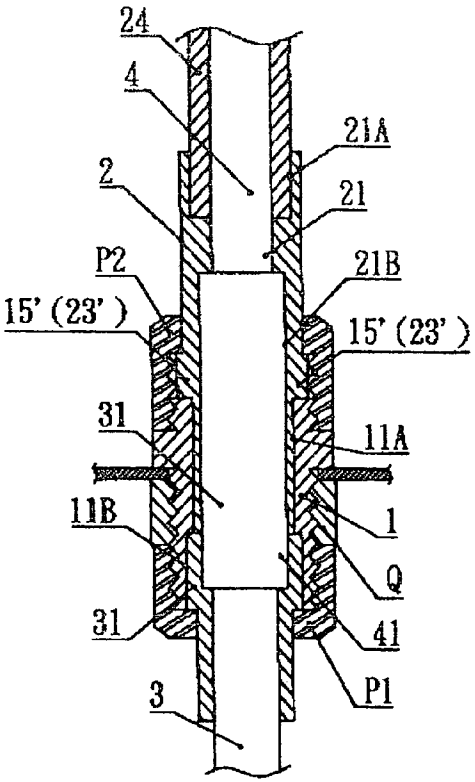
FIG. 3B is a plane cross section view of the present invention after the lamp rod is inserted into the wire connecting box.
Figure 3A:
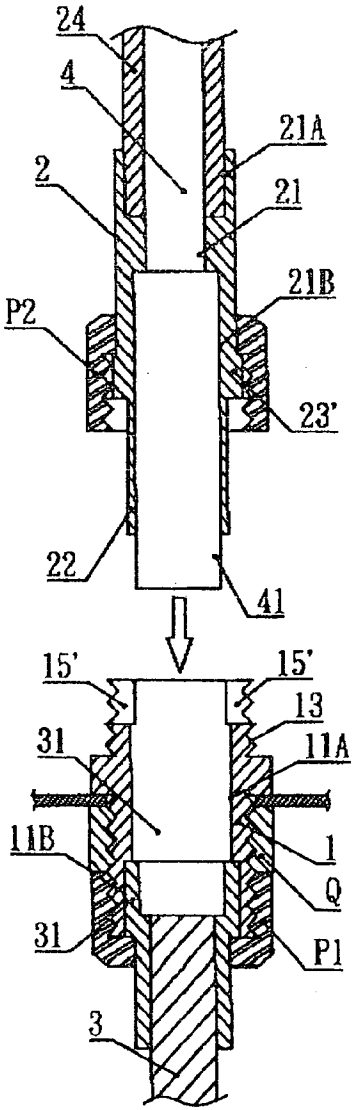
FIG. 3A is a plane cross section view of the present invention before the lamp rod is inserted into a wire connecting box.

The assembly of the present invention will be described hereinafter. Referring to FIG. 3, after the electric wire 3 is inserted into the retaining seat 1, it is locked to the bottom plate D1 by screwing the female screw Q with the rear threaded section 14 so that the female joint 31 of the electric wire 3 exactly protrudes from the larger stepped hole 11B of the retaining seat 1. The electric wire 4 is inserted into the locking seat 2 from a lower end thereof in advance. The male joint 41 of the electric wire 4 protrudes out of the bottom end of the locking seat 2. Thereby, when the locking seat 2 is inserted into the retaining seat 1 and locked therein by using the inner threaded ring P1. Then the top of the locking seat 2 is welded with the lamp rod 24. Thereby, when the locking seat 2 is inserted into the retaining seat 1, the lower end 22 of the locking seat 2 is exactly inserted into the smaller stepped hole 11A of the retaining seat 1, and the female joint 31 protruding from the lower end of the locking seat 2 is exactly engaged with the male joint 41 positioned in the larger stepped hole 11B. Thereby, the retaining seat 1 and the locking seat 2 are conductive. Thereby, the inner threaded ring P1 is tightly locked to the ear threaded section 14 so that the locking seat 2 is positioned above the retaining seat 1. When it is desired to detach the locking seat 2 from the retaining seat 1, it is only necessary to loose the inner threaded ring P1, and then the locking seat 2 is detached from the retaining seat 1.

Thereby, when it is desired to package, transfer, or store the lamp seat, the locking seat 2 and the lamp rod 24 can be pulled out from the retaining seat 1 so that the locking seat 2 and the lamp rod 24 are disposed separately and thus the space for placing the two is reduced. Moreover, since the retaining seat 1 is assembled to the wire connecting box, the user only inserts the locking seat 2 into the retaining seat 1. Then, it can be used without using any locking tool. Thus, the user may assemble it by himself or herself.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A conductive wire insertion device for installing a lamp rod to a bottom plate of a wire connecting box; the bottom plate being formed with a plurality of through holes; the conductive wire insertion device comprising:

a cylindrical retaining seat having a first through hole; a portion of the through hole including a larger stepped hole, into which a female joint of a first electric wire is inserted from one side of the bottom plate; the retaining seat passing through the bottom plate of the wire connecting box, an outer surface of the retaining seat having a front threaded section and a rear threaded section;

a cylindrical locking seat being an integral body; an interior of the locking seat having a two-staged stepped inserting hole including a top stepped hole and a lower stepped hole; the top stepped hole of the inserting hole being welded with a lamp rod; and a cylindrical male joint of a second electric wire being exactly positioned in the bottom stepped hole of the inserting hole; an end portion of the male joint of the second electric wire slightly protruding outwardly from a bottom end of the locking seat;

wherein in assembly, the retaining seat is positioned to the bottom plate by passing the rear threaded section into a selected one of the plurality of through holes of the bottom plate and a female screw being screwed to the rear threaded section; the rear threaded section of the retaining seat being locked to a first ring, having a first inner thread section; the first electric wire passes through the first ring; a lower end of the first ring having an inner flange supporting a female joint of the first electric wire;

then the locking seat is inserted into the retaining seat from a top end thereof; the male joint of the second electric wire has an end portion which is exactly inserted into the female joint of the first electric wire; as a result, the first and second electric wire are conducted; after the locking seat is inserted into the retaining seat, a second ring having a second inner thread section being placed around an upper part of the locking seat; the second ring is exactly locked to the front threaded section of the retaining seat; thereby, the locking seat is positioned to the retaining seat; wherein an outer side of the retaining seat is protruded with a flange for resisting against the bottom plate.

2. The conductive wire insertion device as claim in claim 1, wherein a top edge of the retaining seat is protruded with two protrusions, and an outer surface of the locking seat are formed with grooves which are engagable with the protrusions of the top edge of the retaining seat so as to prevent the locking seat from rotation.

3. The conduction wire insertion device as claimed in claim 1, wherein a top edge of the retaining seat is protruded with two protrusions or two grooves for preventing the locking seat from rotation.

4. The conduction wire insertion device as claimed in claim 1, wherein the rear threaded section of the retaining seat is locked to an inner threaded ring; the first electric wire passes through the inner threaded ring; a lower end of the inner threaded ring exactly supports the female joint of the first electric wire for preventing the electric wire from falling down.

5. The conduction wire insertion device as claimed in claim 1, wherein in the top stepped hole of the locking seat, a hollow lamp rod is welded therein; and the lamp rod is passed through by the second electric wire.

* * * * *